US006874651B2

(12) United States Patent
Matiere

(10) Patent No.: US 6,874,651 B2
(45) Date of Patent: Apr. 5, 2005

(54) SEALED AND RESISTANT TANK

(75) Inventor: Marcel Matiere, Aurillac (FR)

(73) Assignee: Societe Civile de Brevets Matiere (FR)

( * ) Notice: Subject to any disclaimer, the term of this patent is extended or adjusted under 35 U.S.C. 154(b) by 123 days.

(21) Appl. No.: 10/468,100

(22) PCT Filed: Feb. 15, 2002

(86) PCT No.: PCT/FR02/00602

§ 371 (c)(1),
(2), (4) Date: Jan. 28, 2004

(87) PCT Pub. No.: WO02/066770

PCT Pub. Date: Aug. 29, 2002

(65) Prior Publication Data

US 2004/0112901 A1 Jun. 17, 2004

(30) Foreign Application Priority Data

Feb. 16, 2001 (FR) ..... 01 02182

(51) Int. Cl.[7] ..... B65D 1/34

(52) U.S. Cl. ..... 220/567.1; 220/62.22; 220/4.12

(58) Field of Search ..... 220/567.1, 565, 220/4.12, 62.22, 62.21

(56) References Cited

U.S. PATENT DOCUMENTS 4,190,159 A * 2/1980 Hoyt ..... 206/524
4,876,124 A * 10/1989 Dallum ..... 428/34.5
5,090,586 A * 2/1992 Mitchell ..... 220/560.03
5,829,625 A * 11/1998 Imagawa ..... 220/567.1

FOREIGN PATENT DOCUMENTS

| | | |
|---|---|---|
| DE | 668 553 | 11/1938 |
| DE | 12 87 301 | 1/1969 |
| EP | 0240979 A2 | 10/1987 |
| WO | WO-82/04090 | 11/1982 |

* cited by examiner

*Primary Examiner*—Joseph Man-Fu Moy
(74) *Attorney, Agent, or Firm*—Connolly Bove Lodge & Hutz LLP

(57) ABSTRACT

The invention concerns a tank for a fluid product, having a bottom (4) and a resistant side wall (10) composed of juxtaposed prefabricated panels (1) each comprising a wall element (2) covered, on an internal face (22), with a continuous sealing sheet (3) extended by three sections (33, 33', 34) which cover respectively the lateral sides (23, 23') and the lower side (24) of the wall element (2) and overlap on the outside of the wall (10). Said panels are placed on a slab (4) covered with a sealing sheet (42) and the adjacent overlapping sections of the sealing sheets (3, 42) covering the set of the panels (1) and the bottom (4) are connected together in a sealed fashion.

Such a tank which is easy to build and to maintain, can contain drinking water or a polluting product.

20 Claims, 3 Drawing Sheets

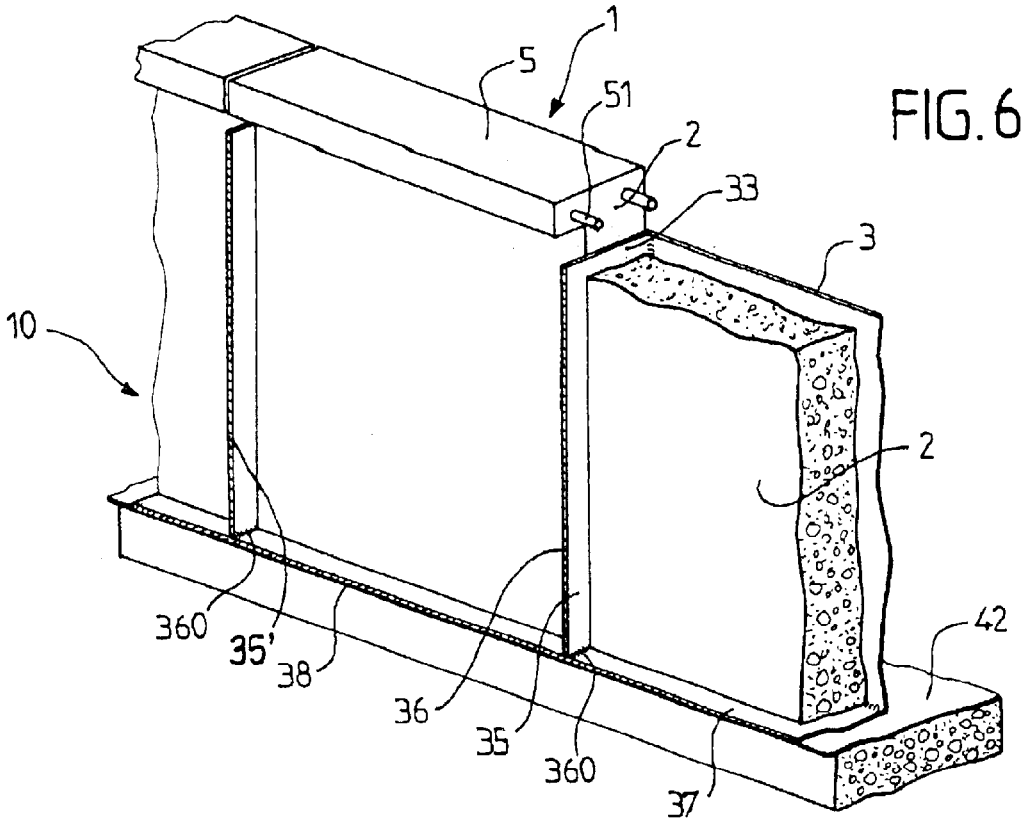
FIG. 6
FIG. 7
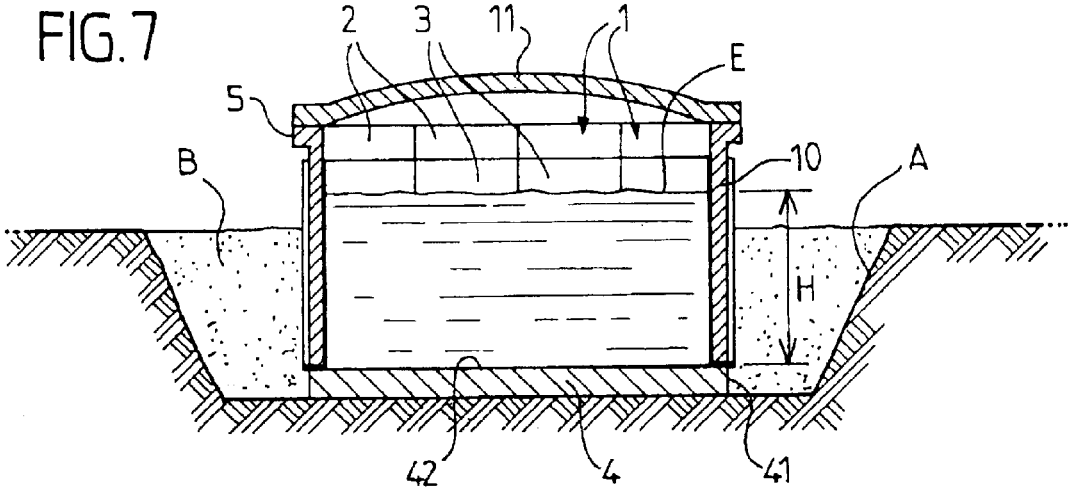
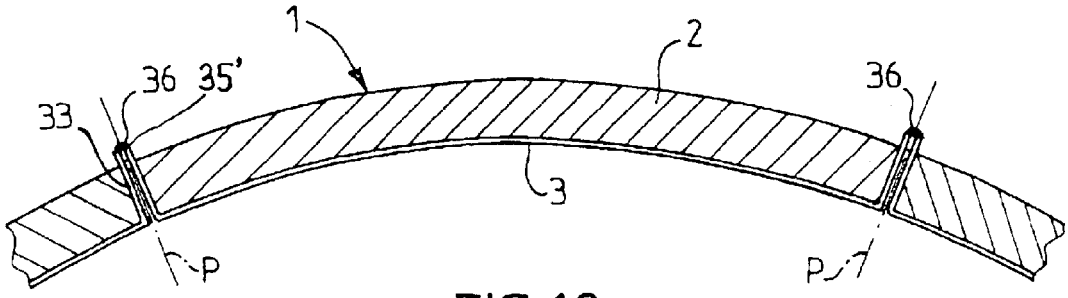
FIG. 12

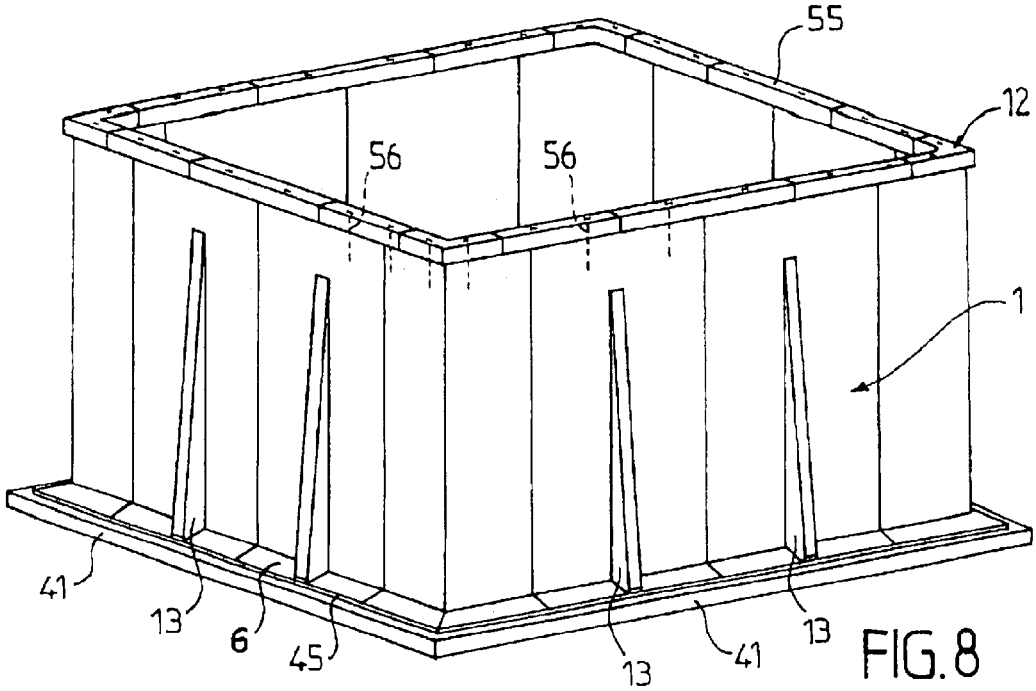
FIG.8
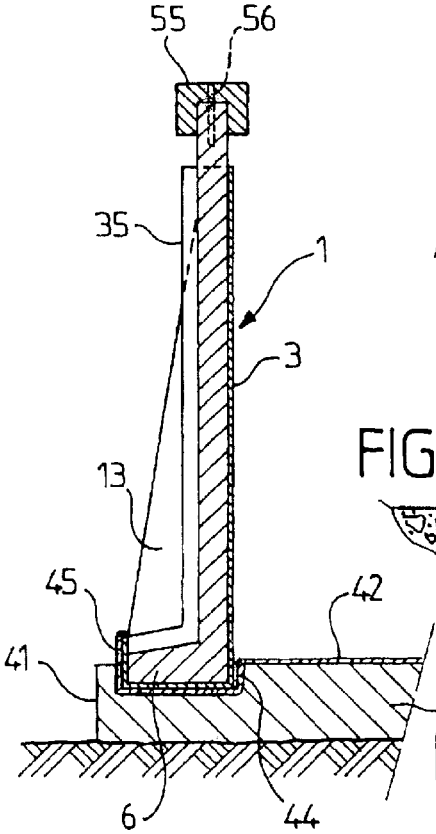
FIG.11
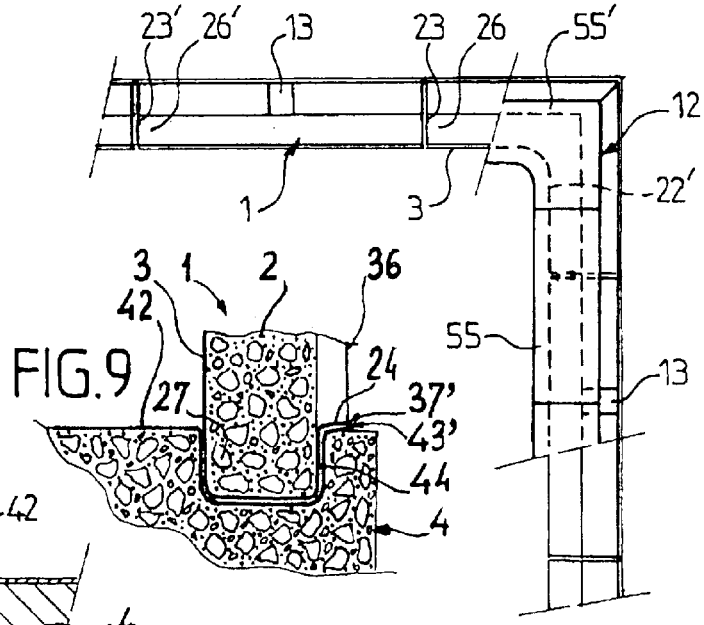
FIG.9
FIG.10

SEALED AND RESISTANT TANK

The purpose of the invention is a sealed and resistant tank, having a bottom and a side wall composed of prefabricated elements and also covers a method of construction of such a tank.

It is often necessary to build the tanks with more or less large a capacity, for instance for the distribution of drinking water, or for the storage of any fluid product, in industry or in agriculture.

Such tanks are generally delineated by a lateral wall which when in service, must sustain the pressure of the product contained inside the tank and which is generally connected to a sealed bottom in order to avoid water losses or infiltrations in case of a polluting product.

To obtain, economically, the necessary resistance, the lateral wall and the bottom are often made of armoured or prestressed concrete.

However, such a tank must also be sealed sufficiently, to avoid leakages, in particular, if the product contained therein is corrosive or harmful.

Generally, it is considered that the concrete is not sealed sufficiently in itself and it is therefore necessary to cover the internal face of the wall with a layer of a sealing product.

If the tank must contain drinking water, it is indispensable, obviously, that the sealing product should be adapted to that usage. Moreover, the tank must be cleaned periodically and the sealing layer may be damaged. On the other hand, certain corrosive products may, in the long run, attack the sealing coating and the concrete.

The maintenance costs of such tanks can therefore be rather high and it is often necessary to replace the sealing layer and even, sometimes, the whole tank, after a few years of operation only.

The invention enables to remedy such shortcomings thanks to a new embodiment of tanks with little maintenance costs and a lifetime longer than that of the tanks produced by the methods known until now. The invention applies especially to the storage of drinking water, but may have other interesting applications.

According to the invention, the lateral wall of the tank is composed of a set of juxtaposed prefabricated panels, each comprising a wall element with sufficient thickness to sustain the pressure of the fluid, with two lateral sides, an upper side and a lower side and covered, on an inner face, with a continuous sealing sheet extended by three sections covering respectively the lateral sides and the lower side and having each a length greater than the thickness of the element in order to emerge outside the wall by a overlapping section. Said panels are applied against one another by their lateral sides and rest, by their lower side on a slab forming the bottom of the tank and covered with a sealing sheet having a peripheral overlapping section extending outside the wall placed on the slab, and the adjacent overlapping sections of the sealing sheets covering the set of panels and the bottom are connected together in order to delineate a sealed tank. To this end, the lateral overlapping sections of the sealing sheet of each panel are connected in a sealed fashion with the lateral overlapping sections of the adjacent panels and the lower overlapping section is connected with the peripheral section of the sealing sheet covering the bottom of the tank.

In a preferred embodiment, the sealing sheet covering each panel is composed of metal adapted to the fluid contained and the overlapping sections of the sheets of both adjacent panels are connected together by welding their external edges.

But the sealed link can also be realised by crimping or gluing.

Particularly advantageously, the sealing sheet is made of stainless steel, in particular for tanks containing drinking water. Certainly, stainless steel is relatively expensive, but, as the pressure resistance is provided by the concrete wall, the thickness of the sealing sheet may be very little, consequently, the increase in the cost of construction is compensated for by the reduction of the maintenance costs and the increase in the lifetime of the tank.

Besides, stainless steel can even be profitable for tanks containing other products, for instance hydrocarbons or for liquid manure pits in agriculture, since it resists far better to corrosion and the cleaning is facilitated.

To build such a tank having a bottom and a lateral wall, first of all the bottom is realised, said bottom being composed of a concreted slab whereon a continuous sealing sheet is applied, having a peripheral edge, and a set of juxtaposed panels forming the lateral wall, are laid on this slab, along said peripheral edge and covered each with a sealing sheet having three overlapping sections, folded along both lateral sides, and on the lower side, said panels being laid next to one another, so that the overlapping sections folded are applied onto one another and a sealed link is provided, on the one hand, at the bottom, between the peripheral edge of the sheet covering the slab and the external edge of the sheet folded on the lower side of each panel and, on the other hand, in each jointing plane between two panels, between the external edges, of the sections of the sheets folded on the lateral sides adjacent to said panels.

Particularly advantageously, the external sections of the sealing sheets overlapping outside the wall are grounded electrically, to ensure cathodic protection.

Generally, such a tank is provided in the bottom of a pit which is backfilled around the lateral wall, after the laying thereof.

The backfill can therefore provide the interconnection of the juxtaposed panels. On the other hand, since the external sections of the sealing sheets are buried in the backfill, said backfill can constitute the electric ground providing the cathodic protection.

However, after carrying out the welding operations, it is also possible to cast, around the base of the panels, a concrete locking belt.

Such a belt can also be formed at an intermediate level, or at the upper section of the panels, above the maximal level of the product contained in the tank.

In particular, such an interconnection belt can be composed of elements in the form a beam, arranged behind one another, along the upper section of the wall. Preferably, each element extends on both sides of a jointing plane between two adjacent panels, and is tightly linked with said panels to form a continuous belt.

Advantageously, this interconnection belt can be composed of at least one oblong part having, in cross section, a U-shaped profile and covering the upper section of the wall.

The invention, as claimed, also covers other advantageous characteristics which will appear in the following description of certain particular embodiments, given for illustrative purposes and represented on the appended drawings.

FIG. 6 is a partial view, in perspective, of the wall.

FIG. 7 shows diagrammatically, as a vertical sectional view, a tank according to the invention.

FIG. 8 is a perspective view of another embodiment of the tank.

FIG. 9 is a detailed view of the base of a panel.

FIG. 10 is a partial top view.

FIG. 11 is a sectional vertical view of the wall.

FIG. 12 shows, as a top view, a variation with curved wall.

Generally, as shown diagrammatically on FIG. 7, a tank according to the invention comprises a lateral wall 10, composed of prefabricated panels 1 laid on a bottom 4 and delineating a capacity (E) which may contain a fluid product, for instance water.

Figure 1:
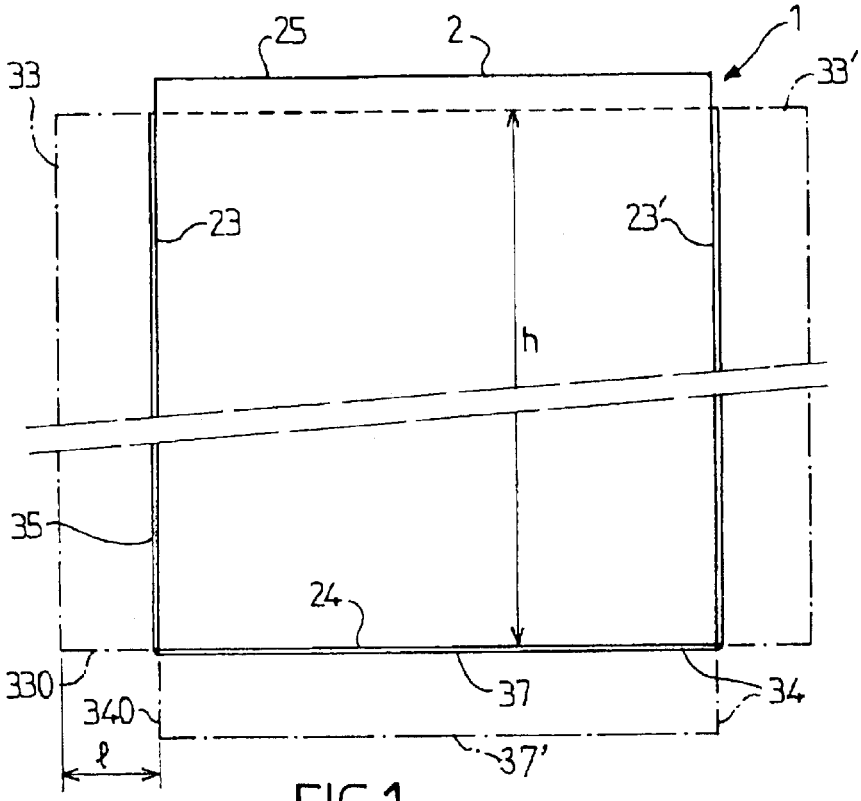
FIG. 1 is a front view of a prefabricated panel according to the invention.
Figure 3:
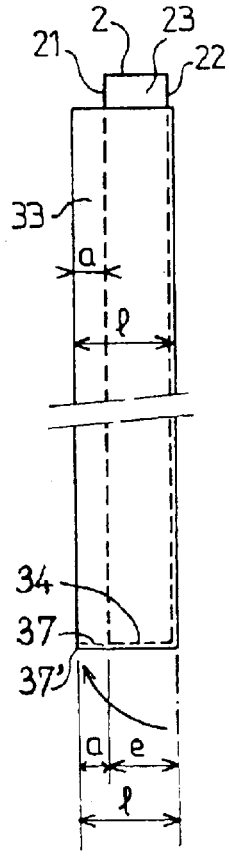
FIG. 2 and FIG. 3 are, respectively, a top view and a side view of the panel.
Figure 2:
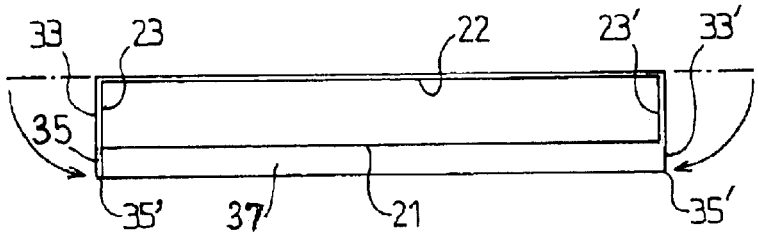

As shown on FIGS. 1, 2 and 3, each prefabricated panel 1 comprises a resistant wall element 2, for instance of armoured concrete, having an external face 21 and an internal face 22 whereon is applied a sealing sheet 3 composed, for instance, of thin metal bands forming edge to edge-welded courses.

The structural features of the wall element 2, in particular its thickness (e) as well as its armouring are determined in relation to the loads to sustain in operation, in particular to sustain the pressure of the fluid product (E) contained in the tank.

Conversely, the metal sheet 3 applied on the panel 2 does not support any load and provides only the sealing. Its thickness depends therefore only on the operating conditions and may range, for instance, from several tenths to 1 or 2 millimetres.

Each panel 1 has, preferably, a rectangular shape comprising two lateral sides 23, 23', a lower side 24 and an upper side 25.

The sealing sheet 3 covers the whole internal face 22 of the resistant element 2, at least on a height (h) greater than the maximal height (H) of the product (E) contained in the tank.

Preferably, the sealing sheet 3 covers a surface area larger than that of the inner face 22 of the resistant element 2, and is prolonged by three sections 33, 33', 34 which extend beyond the corresponding sides 23, 23', 24 of the element 2, each over a distance (I) greater than the thickness (e) of the element 2.

These prolongations 33, 33', 34 of the sheet 3 are folded and applied on the lateral sides 23, 23' and the lower side 24 of the element 2, in the way shown by the arrows on FIG. 2, and extend therefore up to an external edge 35', 37' which is spaced apart from the external face 21 of the element 2 by a distance $$a=I-e$$

Thus, each panel 1 is surrounded, on three sides 23, 23', 24, by overlapping sections, respectively lateral 35 and lower 37 overlapping sections, each having a rectilinear external edge 35', 37'.

To facilitate the folding of the sealed sheet 3, it is preferable that the edges of the panel 2 should be round.

A each angle of the panel 1, the lateral edges 330, 340 of the prolongations 33, 34 folded on the sides 23, 24 touch one other and are connected by a welding bead 360, so that, on the height (h) of the sheet 3, the concrete resistant element 2 is housed inside a sealed caisson formed by the sealing sheet 3 and having three overlapping sections 33, 33', 34, extending beyond the external face 21 of the element 2.

This caisson can advantageously be made in advance and placed in the bottom of a mould in order to act as a disposable casing for moulding the prefabricated panel 1.

Such prefabricated panels enable to make easily and quickly a sealed tank as shown diagrammatically on FIG. 7, which illustrates the case of a semi-buried tank.

At the bottom of a trenching (A), performed in the ground, a concrete slab 4 is cast first of all over a surface slightly greater than the cross section to confer to the tank and which is delineated by a peripheral lateral side 41.

The slab 4 is then covered with a continuous sealing sheet 42 which can possibly be placed before the concrete has set, in order to be interconnected with said concrete.

Figure 5:
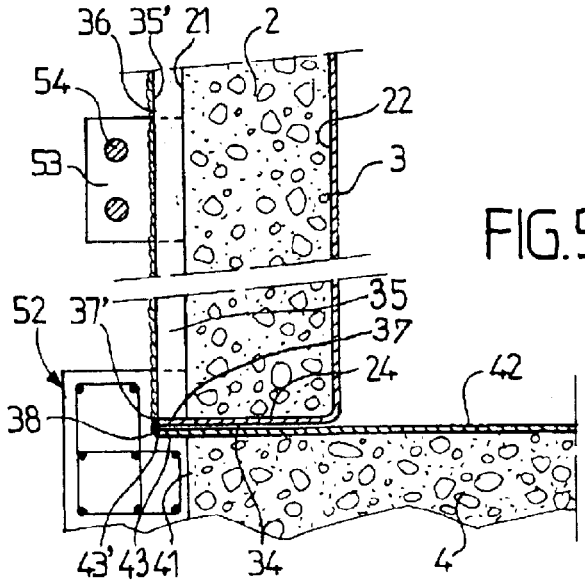
FIG. 5 is a vertical sectional view, at enlarged scale, of the junction between a panel and the bottom of the tank.

As shown in the detailed view of FIG. 5, the sealing sheet 42 covers a surface area larger than of the slab 4 and extends therefore up to a peripheral edge 43' placed beyond the lateral side 41 of the slab 4.

A set of prefabricated panels 1 can be then laid on the slab 4, said panels being made in the way indicated previously and juxtaposed in order to form the lateral wall 10 of the tank.

Figure 4:
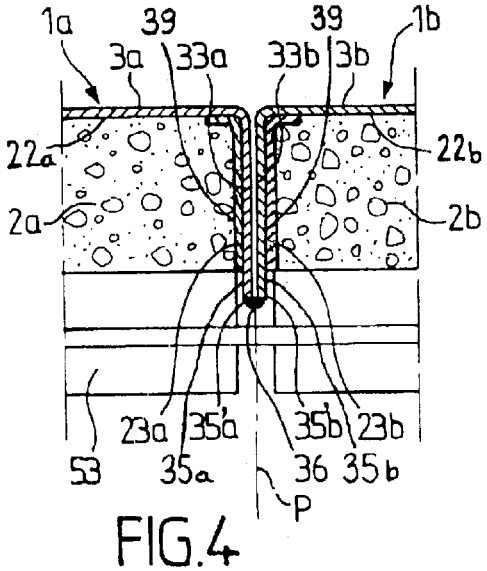
FIG. 4 is a horizontal sectional view, at enlarged scale, of the junction between two adjacent panels.

As shown on FIG. 4, which is a detailed view, as a horizontal section, of the joint between two adjacent panels 1*a*, 1*b*, the overlapping sections 33*a*, 33*b* of the sealing sheets 3*a*, 3*b* are applied on top of one another in the jointing plane (P), between the corresponding lateral sides 23*a*, 23*b* of both panels 1*a*, 1*b* and the rectilinear external edges 35'*a*, 35'*b* of both sealing sheets extend beside one another.

If the sealing sheets 3*a*, 3*b* are made of metal, in particular of stainless steel, it is therefore possible to make a welding bead 36 along the junction between the external edges 35'*a*, 35'*b* of both sealing sheets 3*a*, 3*b* and thus, to seal the wall against the pressure applied to the internal faces 22*a*, 22*b* of both panels by the fluid contained in the tank.

A sealed link between the edges 33, 33' of the panels can also be provided by a crimping operation.

On the other hand, each prefabricated panel 1 rests, by its lower side 24, along the side of the slab 4. The folded prolongation 34 of the sealing sheet 3 is applied on the sealing sheet 42 covering the bottom 4 and extends beyond the lateral side 41 of said bottom by a overlapping section 37 delineated by a rectilinear external edge 37' which extends along the peripheral edge 43 of the sealing sheet 42 and can be welded to said edge by a welding bead 38.

Thanks to this disposition, as shown on the perspective view of FIG. 6, the sealing sheets 3 of each panel 1 are connected in a sealed fashion, respectively together by the welding beads 36 and with the sealing sheet 42 of the bottom 4 by the peripheral welding bead 38.

These welding beads are capable to sustain the pressure of the fluid contained in the capacity delineated by the lateral wall 10 and which can infiltrate between the sections 33*a*, 33*b* of the sealing sheets which are applied on top of one another. This infiltration can, besides, be limited by applying a sealing product, for instance silicon, between the opposite faces 33*a*, 33*b* of both panels 1*a*, 1*b*.

In a preferred embodiment, the lateral sides 33, 33' of the caisson 3 and, possibly the lower side 34 are reinforced by an extra layer of metal or by a band 39 interposed between the external sheet 33 and the side 23 of the concrete element 2, as indicated on FIG. 4. This band 39 can besides be elbowed in order to cover the rounded connection edge with the internal face 21. The rigidity of the panel 1 is thus increased while avoiding the risk of warping during extraction from the mould and during transport, which guarantees the application of the edges to be welded 35'*a*, 35'*b* on top of one another and the long-term hold of the welding bead 36, 38.

After laying the set of the panels forming the lateral wall 10, the trenching (A) is filled, around the tank, by a backfill (B) which prevents the panels from moving apart under the pressure of the water, after filling the tank.

If the prefabricated panels are plane, the tank exhibits a square or rectangular section. But it is also possible, as shown on FIG. 12, to make curved panels which enable to provide a continuous curved wall.

If the water height is not too high, a backfill made correctly can be sufficient to provide the necessary resistance to the water thrust while preventing the panels from moving apart. But it is preferable to provide an armoured concrete chaining 52 at the lower section of the tank to interconnect the bases of the panels together and with the slab 42. Such a chaining 52 can be cast in place after realising the welding beads 38 and 36.

On the other hand, it is possible, for safety reasons, to interconnect together the panels at their upper section, above the maximal level of the water.

Indeed, as shown on FIG. 6, the resistant element 2 of each panel 1 can be prolonged by an upper section 5 forming a beam, wherein can be arranged, for instance, passage ducts of one or several prestressing bars 51.

After laying the set of panels, the bars 51 may be thread through the aligned ducts and stressed to provide the interconnection of the assembly, at least at the upper section of the panels.

One thus provides a chaining 5 which can constitute a base for a closing lid 11 of the tank.

It is also possible to make an interconnection belt, at an intermediate level, for instance in the way indicated diagrammatically on FIG. 5.

Each wall element 2 is then fitted, on its external face 21, on the overlapping section in the form of a beam 53 which extends outwardly, beyond the external edges 35 of the folded sections of the sealing sheet.

The overlapping sections 53, which are placed at the same level, lie in the alignment of one another when the panels 1 are positioned on the slab 4 and are connected together in order to form a belt surrounding the whole wall.

One or several prestressing bars 54 running through aligned ducts, provided in the overlapping sections 53 and running outside the welding beads 36, enable to provide the interconnection of the panels and to prevent them from moving apart under the thrust of the water contained in the tank.

The invention enables thus to make, simply and rapidly, a tank whereof the form, the height and the capacity can be determined to suit the requirements.

Indeed, it is possible to have, in factory, moulds which are easily adaptable to the requested dimensions and make quickly the number of necessary panels, said panels having a width corresponding to the road gauge, which enables to transport them as piled up on a simple trailer.

However, the width of certain panels may vary in order to confer the requested dimensions to the tank.

But a sufficient number of prefabricated panels having different heights can be also produced in advance.

According to the dimensions of the tank to be made, one can then choose, in the stock available, the number of necessary panels to build the wall and to deliver them quickly to the site.

Certain panels may have a particular shape and, during moulding, one can provide recesses or incorporate therein accessory members, for instance for the connection of the supply and evacuation ducts.

After digging the trenching to provide the footing layer, the concrete slab 4 is cast and covered it with the sealing sheet 42, which can advantageously be composed of metal bands unwound side by side on the slab 4 and butt-welded or butt-crimped.

By means of a simple crane, the set of juxtaposed panels are then laid on the slab and the external edges of the sealing sheets are welded, then the interconnection belts are set. The trenching can then be backfilled.

Since all the welds are made outside the tank, one can prevent the interventions inside said tank and consequently the risks of damage to the sealing sheets.

On the other hand, the protrusion outside the overlapping sections 35, 37, 43 of the sealing sheets enables to provide a permanent contact with the backfilled earth around the tank and, thus, the grounding of said tank for cathodic protection.

Moreover, it is possible to connect electrically all the welded spots to an earth.

Besides, since the prefabricated panels 1 are connected together only by the welded spots 35 and the interconnection belts 5, 53, the wall keeps a relative flexibility and absorbs easily the thermal variations, the folded sections 33*a*, 33*b* of the sealing sheets welded by their external edges 35 forming bellows using as expansion joints.

Obviously, the invention is not limited to the single embodiment which has just been described for exemplification purposes and which can be subject to variations using equivalent means to fulfil the same functions, without departing from the protection framework defined by the claims.

For example, to provide the interconnection of the panels at their base, said could be embedded in the slab 4, in the way represented on FIG. 9. The slab 4 is then fitted, on its whole contour, with a peripheral groove wherein engages the base of each panel 1 or a simple groove forming a lug. In this case, it is not necessary to make a lower belt, the thrust of the fluid being absorbed by the groove. The sealed sheet 42 which covers the slab 4 can be formed in order to cover the bottom of the groove 44, as well as the folded section 34 of the sheet 3 covering each panel, the external edges 37 and 43 being welded together as previously.

It is advantageous to weld together the overlapping sections 33, 33' and 34 of the sealing sheet covering each panel 1 to provide a kind of sealed caisson, but a continuous sheet, simply folded in the angles could be also used.

Indeed, as the resistance to the stresses applied is provided by the wall element 2, the sealing sheet 3 can be very thin and can therefore be folded easily.

Besides, it is advantageous to reduce the welding length, to use a sheet 3 folded on the sides of the wall element 2. But it could be also possible to use a sheet 3 of the same dimensions as the internal face of the panel and butt-welded to the metal bands covering each side 23, 24 of the element 2.

On the other hand, in the embodiment which has just been described, the panels 1 have the form of a rectangular slab, particularly simple to make. However this form can be modified while keeping the advantages of the invention. FIGS. 8, 9 and 10 for instance, represent a tank wherein each prefabricated panel 1 comprises a widened base 6 which enables the panel to stand upright by itself, and can advantageously engage into a groove 44 of corresponding width, arranged on the periphery of the slab 4.

Said slab is covered with a sealing sheet 42 which, by reason of its thinness, can be formed in order to cover the bottom of the groove 44, while emerging outside said groove through a raised section 45.

Similarly, the sealing sheet 3 which covers the internal face of the panel is folded on the lower face of the base 6 and may emerge outside in order to be welded with the section 45 of the sealing sheet 42 covering the slab 4.

In case of need, the prefabricated panels 1 could also be fitted on their lateral sides, with matching sections, respectively hollow and overlapping, enabling to nest two adjacent panels into one another, the sealing sheet 3 being formed in order to follow the profile of the nesting.

Certain panels can also have a particular shape. For instance, the lateral wall comprises, preferably, at each angle, a square panel 12 which enhances the rigidity of the assembly and facilitates the laying of the plane panels.

The upper belt can also be composed of U-shaped oblong parts 55, which cover the upper section of the panels 1.

Advantageously, each U-shaped part 55 has a length equal to the width of a panel 1, but is offset of half a pitch in order to cover two adjacent panels, as represented on FIG. 8.

On the other hand, the U-shaped parts 55 can be interconnected with the panels 1 by sealed pins 56.

In the angles, square parts 55' can also be used to cover the angle panels 12 of the wall.

Preferably, at each angle, the internal face 22' of the square part 12 is rounded in order to provide perfect application of the sealing sheet 3 which covers the part 12.

Besides, each panel 1 can be fitted with a groove 13 which enhances the rigidity of the panel and enables to dispense with the laying of an intermediate belt, the panels being held simply at their upper section by the U-shaped parts 55 and at their lower section by the groove 44 of the slab 4.

It is easier to make plane panels and, consequently, tanks with rectangular section, but, as shown on FIG. 12, curved panels enabling to make a curved wall could be also used.

On the other hand, if the sides 23, 23' of each panel 1 should be rectilinear to enable the sealing sheet 3 to be folded, they need not be parallel.

Indeed, when a curved wall is realised, as in the case of FIG. 12, each panel could have a general trapezoid shape, with convergent lateral sides in order to form a conical wall.

As indicated, since the sealing sheet covering each panel can be very thin, it is possible to make said sheet out of stainless steel, the increase in price of the material being largely compensated for by the advantages provided, in particular the reduction in the maintenance costs and the best handling in the course of time.

Consequently, a tank, according to the invention, will be particularly adapted to contain drinking water or other foodstuffs, for instance milk.

However, since stainless steel exhibits excellent resistance to corrosion and is easy to clean, the invention could find multiple applications, for instance, for the realisation of tanks containing a hydrocarbon or a harmful or corrosive product such as liquid manure or industrial waste, in order to prevent pollutions of the groundwater table.

Obviously, the quality of the steel should then be adapted to the chemical composition of the product to be stored.

But the sealing sheet of each panel can be also made out of an ordinary metal fitted with an adequate coating or another material, for instance a composite or synthetic product. Similarly, if connecting together the external edges of the sealing sheets 3 by welding or crimping is advantageous, a sealed link could also be obtained by simple gluing of the folded sections 33, 33' applied on top of one another.

The reference signs inserted after the technical features mentioned in the claims solely aim at facilitating the understanding of the said and do not limit their extent whatsoever.

What is claimed is:

1. A tank for a fluid product, having a bottom and a resistant side wall composed of juxtaposed prefabricated panels and covered, on an internal face, by a sealing sheets, wherein each prefabricated panel comprises a wall element having a sufficient thickness to sustain the pressure of the fluid, with two lateral sides, an upper side and a lower side and covered, on an internal face, with a continuous sealing sheet extended by three sections covering respectively the lateral sides and the lower side of the wall element and each extending over a length greater than the thickness of the element in order to extend outside the wall by a overlapping section, in that said panels are applied against one another by their lateral sides and rest, by their lower side on a slab forming the bottom of the tank and covered with a sealing sheet having a peripheral overlapping section extending outside the wall placed on the slab, and in that the adjacent overlapping sections of the sealing sheets covering the set of panels and the bottom are connected together in order to delineate a scaled tank, the lateral overlapping sections of the sealing sheet of each panel being connected in a sealed fashion with the lateral overlapping sections of the adjacent panels and the lower overlapping section being connected with the peripheral section of the sealing sheet covering the bottom of the tank.

2. A tank according to the claim 1, wherein the sealing sheet covering each panel and the bottom is composed of a metal adapted to the fluid (E) and in that the overlapping sections of the sheets of the panels of the wall and of the bottom are connected together by welding or crimping their external edges.

3. A tank according to the claim 2, wherein the sealing sheet covering each panel and the bottom is made of stainless steel.

4. A tank according to claim 1, wherein the sections of the sealing sheets covering the panels are connected together and with the sheet covering the bottom, by gluing.

5. A tank according to claim 1, wherein the overlapping sections of the sealing sheets extending outside the wall are grounded electrically in order to provide cathodic protection.

6. A tank according to claim 1, wherein it comprises linking means between the adjacent panels enabling to sustain the pressure of the fluid (E) contained in the tank.

7. A tank according to the claim 6, whereof the wall extends in height up to an upper level, characterised in that the linking means between adjacent panels are placed above the upper level of the wall and comprise at least one linking member forming a belt surrounding externally the set of panels at a distance from the internal face of said panels greater than the distance (a) between said internal face and the external edges of the sealing sheets.

8. A tank according to the claim 7, wherein each resistant element of a panel is fitted with a section overlapping outwardly from the external face of said element, and in that the overlapping sections of the adjacent panels are placed in the extension of one another and are connected together by at least one oblong linking member counteracting, in operation, the stresses tending to spread two adjacent panels apart from one another.

9. A tank according to the claim 8, wherein the linking member between the adjacent panels comprises at least one prestressing cable or bar resting on the overlapping sections of the panels and subject to a traction load for clamping said panels together.

10. A tank according to the claim 6, composed of panels extending in height at least up to a maximal level of the reserve capacity, characterised in that the linking means between the panels form a belt extending above said maximal level and fitted with means of interconnection with each of the panels.

11. A tank according to the claim 10, wherein the interconnection belt is composed of beam elements arranged behind one another, along the upper section of the wall, each element extending on both sides of at least one jointing plane between two adjacent panels and being interconnected with said panels.

12. A tank according to claim 10, wherein the interconnection belt is composed of at least one oblong part having, in cross section, a U-shaped profile and covering the upper section of the panels.

13. A tank according to claim 1, wherein the slab is fitted, over its whole contour, with a groove wherein engages at least one overlapping section of the lower side of each panel.

14. A tank according to claim 13, wherein the lower side of each panel is widened in order to form a stabilisation foot which engages into a groove with corresponding width, arranged on the periphery of the slab forming the bottom of the tank.

15. A tank according to claim 13, wherein the sealing sheet covering the slab is formed according to the hollow profile of the groove in order to emerge from said groove while extending up to an external edge placed substantially at the upper face of the slab and in that the lower side of the sheet covering each wall element goes up along the external face of said element and extends up to an external edge which, after embedding of the panel, lies substantially at the upper face of the slab, in order to be connected to the external edge of the sheet covering said slab.

16. A tank according to claim 1, wherein the lateral wall of the tank having a polygonal shape comprising several faces planes connecting at an angle, the wall comprises, at each angle, an elbowed panel having two branches which connect each at a plane panel forming at least one section of the plane face of the wall.

17. A method of construction of a tank having a bottom and a lateral wall, wherein the bottom is realised first of all, while casting a concreted slab whereon a continuous sealing sheet having a peripheral overlapping section is applied, in that a set of juxtaposed prefabricated panels are laid on the periphery of this slab to form a wall, each comprising one resistant element covered with a sealing sheet extended by three sections covering respectively both lateral sides and the lower side of the element and extending each over a length greater than the thickness of said side in order to extend outside the wall by a overlapping section and in that a sealed link is realised, on the one hand, at the bottom, between the peripheral overlapping section of the sheet covering the slab and the lower overlapping section of the sheet folded on the lower side of each panel and, on the other hand, in each jointing plane between two panels, between the overlapping sections of the sheets folded on the adjacent lateral sides of said panels.

18. A method according to claim 17, wherein the tank is buried, at least partly, in a pit and in that, after realising the bottom and the wall and the welding of the external edges of the sealing sheets, a backfill is placed around the lateral wall, said backfill providing the interconnection of the juxtaposed panels.

19. A method according to the claim 18, wherein the overlapping sections of the sealing sheets covering the panels of the wall and the bottom are buried, at least at their lower section, in the backfill made around the wall and which constitutes an electrical ground providing the cathodic protection of the sealing sheet.

20. A method according to claim 17, wherein an interconnection belt is realised, at least at the upper section of the panels, above the maximal level of the product contained in the tank.

* * * * *

UNITED STATES PATENT AND TRADEMARK OFFICE

CERTIFICATE OF CORRECTION

PATENT NO. : 6,874,651 B2
DATED : April 5, 2005
INVENTOR(S) : Marcel Matiere

It is certified that error appears in the above-identified patent and that said Letters Patent is hereby corrected as shown below:

Column 7,
Line 67, "sheets" should read -- sheet --;

Column 8,
Line 17, "scaled" should read -- sealed --.

Signed and Sealed this

Seventh Day of June, 2005

JON W. DUDAS
*Director of the United States Patent and Trademark Office*